US007995933B2

(12) United States Patent
Kondo et al.

(10) Patent No.: US 7,995,933 B2
(45) Date of Patent: Aug. 9, 2011

(54) PROCESS CARTRIDGE FOR USE IN IMAGE FORMING APPARATUS AND IMAGE FORMING APPARATUS

(75) Inventors: Masao Kondo, Toyokawa (JP); Koji Ohara, Toyokawa (JP); Takeshi Nomura, Toyohashi (JP); Shinichi Yabuki, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 556 days.

(21) Appl. No.: 12/015,091

(22) Filed: Jan. 16, 2008

(65) Prior Publication Data

US 2008/0219692 A1 Sep. 11, 2008

(30) Foreign Application Priority Data

Mar. 7, 2007 (JP) ..... 2007-057378

(51) Int. Cl.
*G03G 15/00* (2006.01)

(52) U.S. Cl. ..... 399/25; 399/83; 399/111; 711/103

(58) Field of Classification Search ..... 399/25, 399/83, 111; 711/103
See application file for complete search history.

(56) References Cited

U.S. PATENT DOCUMENTS

| | | | | |
|---|---|---|---|---|
| 5,933,846 | A * | 8/1999 | Endo | 711/103 |
| 6,597,875 | B2 | 7/2003 | Hasegawa | |
| 7,031,012 | B1 | 4/2006 | Serizawa | |
| 2002/0170051 | A1 * | 11/2002 | Watanabe et al. | 717/168 |
| 2003/0037213 | A1 * | 2/2003 | Mittag et al. | 711/163 |
| 2005/0003614 | A1 * | 1/2005 | Min et al. | 438/257 |
| 2005/0031360 | A1 * | 2/2005 | Yamazaki | 399/13 |
| 2005/0078969 | A1 * | 4/2005 | Kikuchi | 399/12 |
| 2005/0084272 | A1 * | 4/2005 | Kikuchi | 399/12 |
| 2005/0095017 | A1 * | 5/2005 | Kikuchi | 399/12 |
| 2006/0034626 | A1 * | 2/2006 | Tanaka | 399/12 |
| 2009/0116854 | A1 * | 5/2009 | Kitazawa et al. | 399/12 |

FOREIGN PATENT DOCUMENTS

| | | | |
|---|---|---|---|
| JP | 03-269446 | B2 | 12/1991 |
| JP | 08-129628 | A | 5/1996 |
| JP | 2001-166649 | A | 6/2001 |
| JP | 2001-222192 | A | 8/2001 |
| JP | 2002-067434 | A | 3/2002 |
| JP | 2002-116680 | A | 4/2002 |
| JP | 2002-169429 | A | 6/2002 |
| JP | 2002-258692 | A | 9/2002 |
| JP | 2004-246372 | A | 9/2004 |
| JP | 2005-215599 | A | 8/2005 |

OTHER PUBLICATIONS

Notification of Reasons for Refusal dated Jan. 27, 2009 issued in the corresponding Japanese Patent Application No. 2007-057378, and English-language translation.

Japanese Decision of Patent Grant dated Apr. 20, 2010 issued in corresponding Japanese Patent Application No. 2007-057378, and English-language translation.

* cited by examiner

*Primary Examiner* — David P Porta
*Assistant Examiner* — Casey Bryant
(74) *Attorney, Agent, or Firm* — Buchanan Ingersoll & Rooney PC

(57) ABSTRACT

In an image forming apparatus employing a process cartridge for image forming apparatus which is equipped with a chip including a rewritable non-volatile memory, the non-volatile memory at least includes a read-only region and an arbitrarily rewritable region, a control program for writing data to the read-only region is installed in the arbitrarily rewritable region, and the use of the control program is limited after the completion of the writing of data to the read-only region.

18 Claims, 4 Drawing Sheets

(A)

(B)

PROCESS CARTRIDGE FOR USE IN IMAGE FORMING APPARATUS AND IMAGE FORMING APPARATUS

RELATED APPLICATION

This application is based on application No. 57378/2007 filed in Japan, the contents of which are hereby incorporated by reference.

BACKGROUND OF THE INVENTION

1. Field of the Invention

The present invention relates to a process cartridge for use in image forming apparatus, such as imaging cartridges and toner cartridges, which is mounted in an apparatus body of an image forming apparatus such as copiers and printers. The invention further relates to an image forming apparatus having such a process cartridge for image forming apparatus mounted in an apparatus body thereof. Particularly, a feature of the invention resides in a process cartridge for image forming apparatus, which is equipped with a chip including a rewritable non-volatile memory, the process cartridge designed to effectively prevent cartridge identification information, such as toner color information, from being mistakenly rewritten, the cartridge identification information stored in the non-volatile memory and used for determining on the suitability of the cartridge.

2. Description of the Related Art

The image forming apparatuses such as the copiers and printers, conventionally employ the process cartridges for image forming apparatus, such as the imaging cartridges and toner cartridges, which contain toners therein and which are removably mounted in the apparatus bodies.

Such a process cartridge for image forming apparatus is generally equipped with the chip including the rewritable non-volatile memory such as a flash memory. This non-volatile memory stores: the cartridge identification information, such as the toner color information, used for determining on the suitability of the cartridge; operation history information indicating the condition of toner consumption and the like. A main CPU disposed in the apparatus body communicates with the chip mounted in the process cartridge for image forming apparatus so as to determine on the suitability of the process cartridge for image forming apparatus mounted in the apparatus body, to update the operation history information indicating the condition of toner consumption and the like (see, for example, Japanese Unexamined Patent Publications No. 2001-222192, No. 2002-169429 and No. 2002-258692).

However, the conventional process cartridges for image forming apparatus have the following problems. The cartridge identification information, such as the toner color information, used for determining on the suitability of the cartridge is generally stored in the same rewritable non-volatile memory as that stores the operation history information indicating the condition of toner consumption and the like. Thus, the memory permits such cartridge identification information to be easily rewritten. This leads to the problem that the cartridge identification information stored in the non-volatile memory is overwritten with erroneous cartridge identification information so that the process cartridge fails to accomplish a proper image formation.

As disclosed in Japanese Unexamined Patent Publication No. H8 (1996)-129628), the following technique has been proposed in the art. An information recording medium comprises an IC card equipped with three types of memories including a ROM, a RAM and an EEPROM, and with a CPU for accessing each of the memories. In order to prevent erroneous data from being written to the EEPROM to destruct necessary data, a CPU operation code for reading out data from EEPROM is stored in the ROM, whereas an operation code for writing data to the EEPROM is included in a write command sent from an external apparatus making a write request as needed and the write command is loaded into the RAM so that a program may be executed on the RAM.

However, the aforesaid information recording medium comprising the above IC card must store a program for executing the process of writing data to the RAM. Hence, the RAM must have such a large capacity that the RAM becomes disproportionately expensive as a memory mounted in the process cartridge for image forming apparatus. There are other problems. In a case where the program stored in the information recoding medium is changed, the above operation command included in the write command of the external apparatus must be also changed.

SUMMARY OF THE INVENTION

The invention is directed to a solution to the above various problems encountered in a case where the process cartridge for use in image forming apparatus equipped with the chip including the rewritable non-volatile memory is mounted in the apparatus body for forming images.

In accordance with the invention, a process cartridge for use in image forming apparatus comprises a chip including a rewritable non-volatile memory, and is characterized in that the non-volatile memory at least includes a read-only region and an arbitrarily rewritable region, and that a control program for writing data to the read-only region is installed in the arbitrarily rewritable region and the use of the control program is limited after the completion of the writing of data to the read-only region.

In accordance with the invention, an image forming apparatus comprises the above process cartridge for use in image forming apparatus mounted in an apparatus body thereof.

These and other objects, advantages and features of the invention will become apparent from the following description thereof taken in conjunction with the accompanying drawings which illustrate specific embodiments of the invention.

DESCRIPTION OF THE PREFERRED EMBODIMENTS

Next, a process cartridge for use in image forming apparatus and an image forming apparatus according to an embodiment of the invention will be specifically described with reference to the accompanying drawings. It is to be noted that the process cartridge for image forming apparatus and the image forming apparatus according to the embodiment are not limited to those illustrated by the following embodiments and modifications or changes may be made thereto as needed so long as such modifications or changes do not deviated from the scope of the invention.

Figure 1:
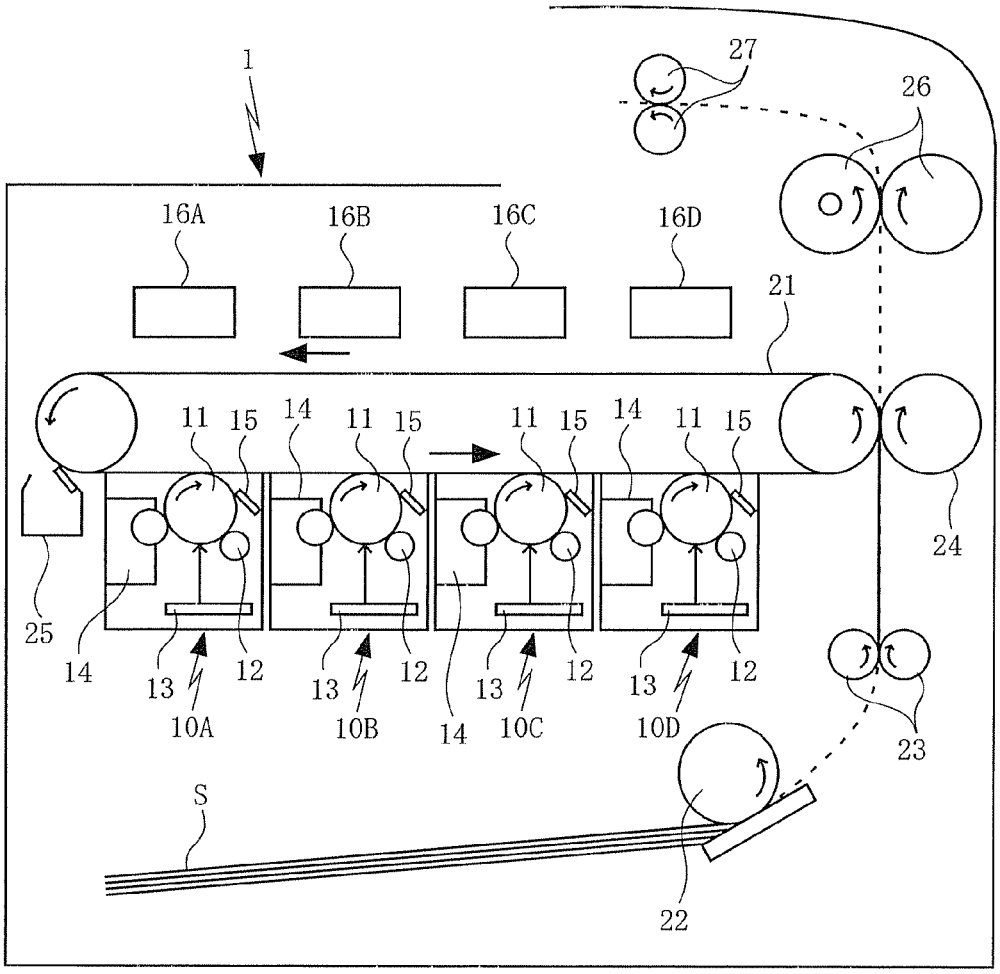
FIG. 1 is a schematic sectional view showing an internal arrangement of an image forming apparatus according to one embodiment of the invention.

In this image forming apparatus, as shown in FIG. 1, four imaging cartridges 10A to 10D as process cartridges for image forming apparatus are mounted in an apparatus body 1.

Each of the above imaging cartridges 10A to 10D includes: a photosensitive member 11; a charger 12 for electrically charging a surface of the photosensitive member 11; an exposure device 13 for irradiating light on the charged surface of the photosensitive member 11 according to image information thereby forming an electrostatic latent image on the surface of the photosensitive member 11; a developing device 14 for supplying a toner to the electrostatic latent image formed on the surface of the photosensitive member 11 thereby forming a toner image; and a cleaner 15 for removing residual toner from the surface of the photosensitive member 11 after the toner image formed on the surface of the photosensitive member 11 is transferred to a transfer belt 21.

In this image forming apparatus, the developing devices 14 of the imaging cartridges 10A to 10D contain therein toners of different colors of black, yellow, magenta and cyan, respectively. Toner cartridges 16A to 16D loaded in the apparatus body 1 supply the toners of corresponding colors to the respective developing devices 14 of the imaging cartridges 10A to 10D.

In a case where the image forming apparatus of the embodiment forms a full-color image, the individual developing devices 14 of the imaging cartridges 10A to 10D supply the toners of the respective colors to the surfaces of the photosensitive members 11 so as to form the toner images of the respective colors on the surfaces of the photosensitive members 11 of the imaging cartridges 10A to 10D.

Subsequently, the toners of the respective colors formed on the surfaces of the photosensitive members 11 of the imaging cartridges 10A to 10D are sequentially transferred to the transfer belt 21, whereby the full-colored toner image is formed on the transfer belt 21.

On the other hand, a sheet feeding roller 22 feeds a recording medium S, which is introduced into space between the transfer belt 21 and a transfer roller 24 in a proper timing by means of timing rollers 23. Thus, the full-colored toner image formed on the transfer belt 21 is transferred to the recording mediums. The toner not transferred to the recording medium S and remaining on the transfer belt 21 is removed from the transfer belt 21 by means of a second cleaner 25.

The recording medium S having the full-colored toner image so transferred thereto is led into space between a pair of fixing rollers 26 so that the full-colored toner image is fixed to the recording medium S. Subsequently, the recording medium S is discharged by means of discharge rollers 27.

Figure 2:
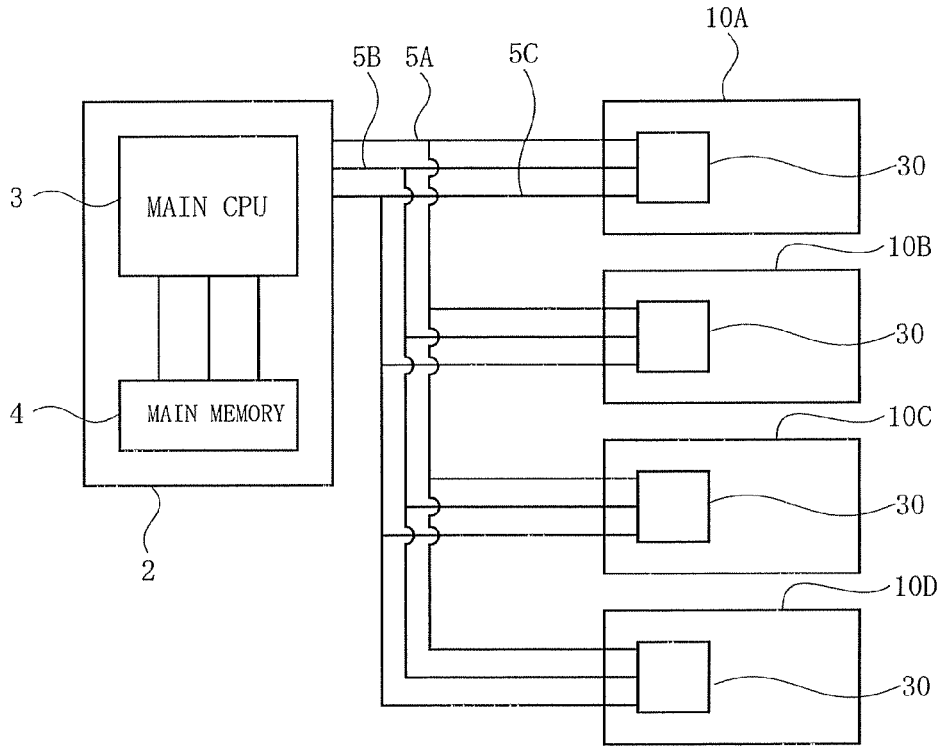
FIG. 2 is a block diagram of the image forming apparatus of the above embodiment wherein a main CPU disposed on a control board of an apparatus body and respective chips provided in individual imaging cartridges perform serial communications via signal lines.

In the image forming apparatus according to the embodiment, as shown in FIG. 2, the apparatus body 1 is provided with a control board 2 including a main CPU 3 and a main memory 4. The main CPU 3 of the control board 2 is connected with a chip 30 disposed in each of the imaging cartridges 10A to 10D via three signal lines 5A to 5C so that serial communications may be carried out therebetween.

Figure 3:
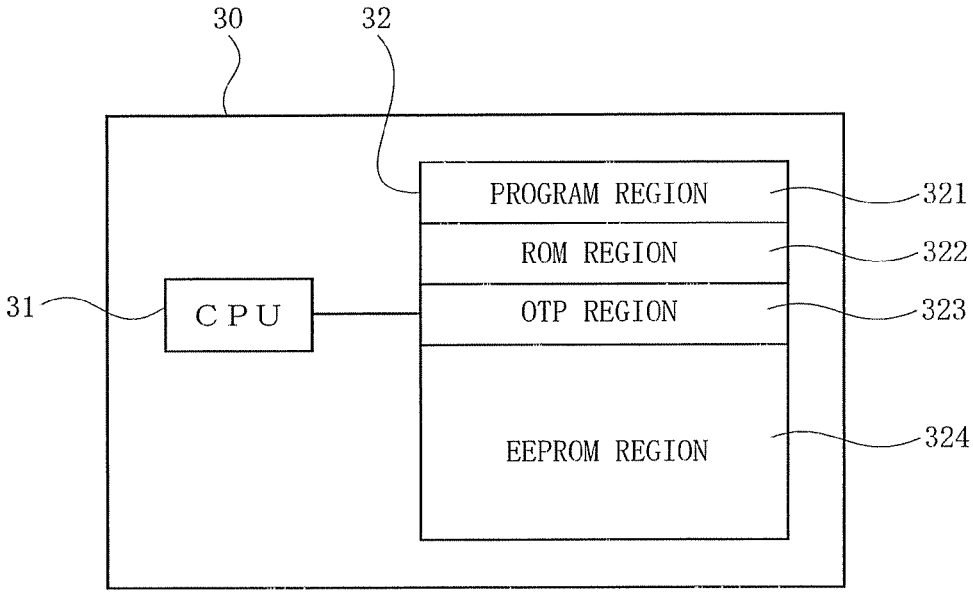
FIG. 3A is a block diagram showing a constitution of the chip disposed in the imaging cartridge of the image forming apparatus of the above embodiment.
FIG. 3B is a block diagram showing a constitution wherein an EEPROM region of a flash memory disposed on the chip is divided into plural banks.
Figure 3:
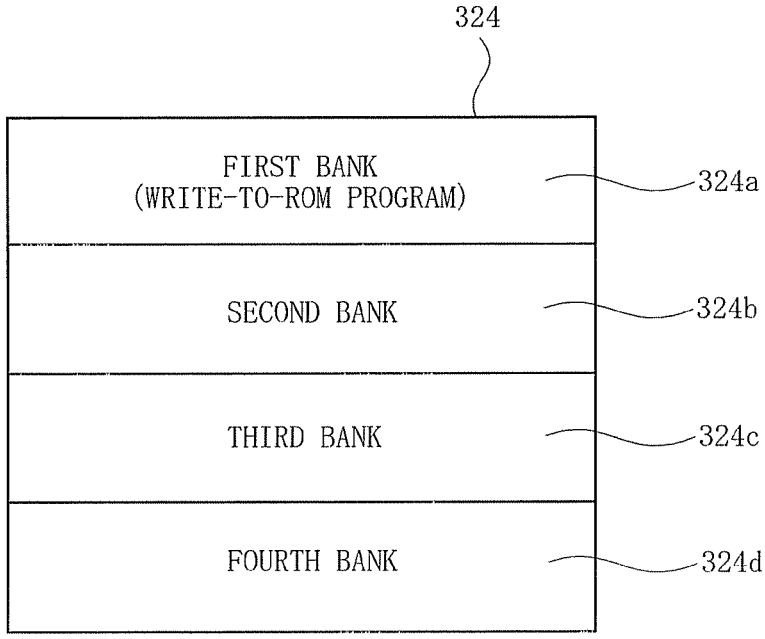

As shown in FIG. 3A, the chip 30 disposed in each of the imaging cartridges 10A to 10D includes: a CPU 31; and a flash memory 32 as a rewritable non-volatile memory. A CPU equipped with flash memory may be used as the chip 30.

The flash memory 32 is divided into a program region providing a variety of controls; a ROM region 322 dedicated to readout; a one time programmable region 323 permitting writing only once; and an arbitrarily rewritable EEPROM region 324.

The EEPROM region 324 is divided into plural banks or into four banks 324*a* to 324*d* as illustrated in FIG. 3B. A control program for writing data to the above ROM region 322 is installed in the first bank 324*a*.

The program region 321 contains programs for communicating with the main CPU 3, writing data to the other regions than the ROM region 322, reading out data from the individual regions, and such.

The OTP region 323 stores an information piece indicating an event occurring only once, such as a cartridge-use start date and an empty detection date, the event related to history information. In a case where the OTP region 323 comprises a memory only permitting bitwise data rewrite from 1 to 0, this region may be used as a new-cartridge detection flag or an emptied-cartridge detection flag such that when such detection is made, the data in the region 323 may be rewritten from 1 to 0 to store the history event.

The ROM region 322 stores an initial value of cartridge identification information used for determining on the suitability of the cartridge, the information including toner color information, type of process cartridge, charged quantity of a developer, manufacture date, orientation information and the like.

The following procedure may be taken to store the above cartridge identification information in the ROM region 322. An external apparatus, for example, may send a write-to-ROM command to the CPU 31 by way of the serial communications. The CPU 31, in turn, may write the aforesaid cartridge identification information to the ROM region 322 based on the aforementioned control program installed in the first bank 324*a* of the EEPROM region 324.

After the cartridge identification information is written to the ROM region 322 in this manner, the write-to-ROM disabling flag is set to 1 so as to inhibit the subsequent writing of data to the ROM region 322. As needed, the aforesaid control program contained in the first bank 324*a* of the EEPROM region 324 may be deleted, so that the ROM region 322 may function as a read-only region.

The EEPROM region 324 stores the other operation history information pieces than that stored in the above OTP region 323. The other history information pieces on the image forming apparatus include, for example, the number of prints to be produced and the ratio between color images and monochromatic images formed by the image forming apparatus.

When the above operation history information is stored in the EEPROM region 324, the operation history information is written to the first bank 324*a* containing the aforesaid control program such that the control program contained in the first bank 324*a* may be overwritten with the operation history information. In this approach, the control program is overwritten with the operation history information without previously deleting the control program and hence, the control program contained in the first bank 324*a* may be disabled. Thus, the ROM region 322 is permitted to function as the region dedicated to readout.

According to the above embodiment, the aforesaid control program is installed in the first bank 324*a* of the EEPROM region 324. It is also possible to divide this first bank 324*a* into plural sub-banks so as to install the above control program in some of the sub-banks. In this case, at least one of the sub-banks containing the control program is deleted or overwritten with the operation history information whereby the control program is disabled.

Figure 4:
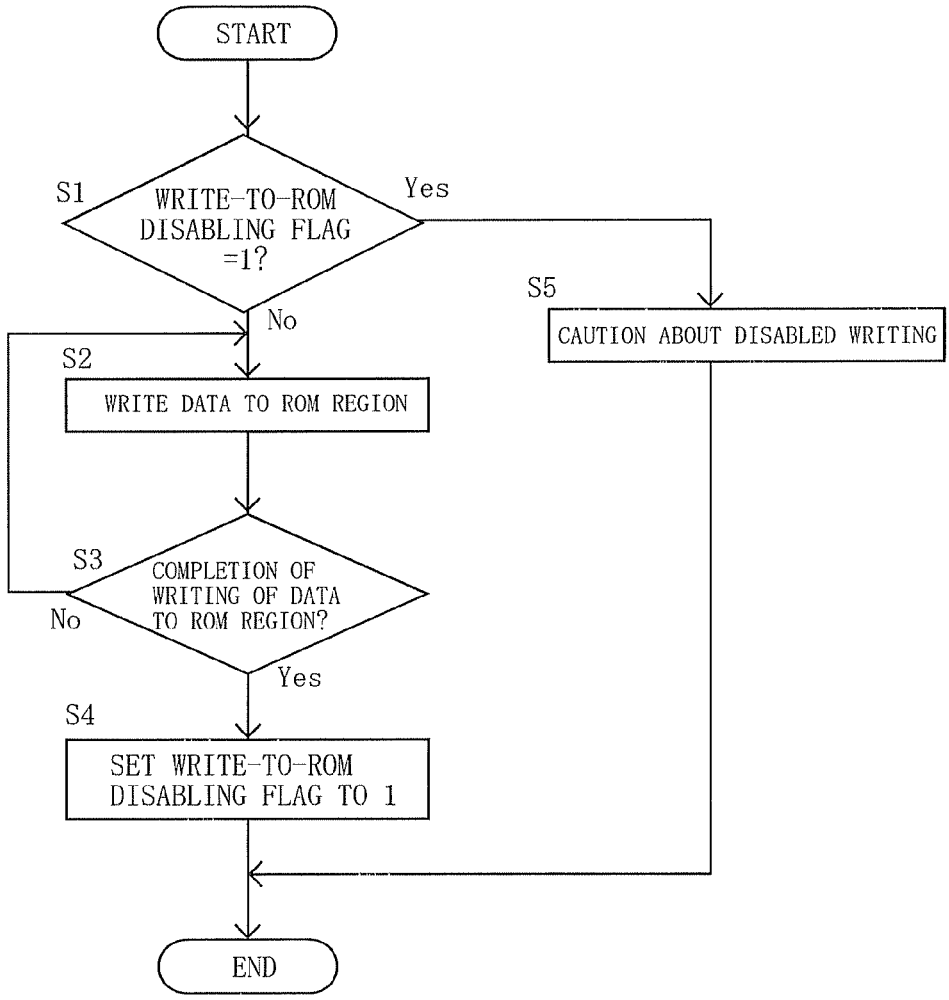
FIG. 4 is a flow chart showing the steps of an exemplary operation of writing cartridge identification information to a ROM region of the flash memory.

Next, an exemplary operation of writing the cartridge identification information to the ROM region 322 dedicated to readout is described with reference to a flow chart of FIG. 4.

First, in Step S1, determination is made as to whether or not the information is already written to the ROM region so as to set the write-to-ROM disabling flag to 1. If the write-to-ROM disabling flag is not 1, the operation flow proceeds to Step S2 where the writing of data to the ROM region is performed in the aforementioned manner.

Subsequently, the operation flow proceeds to Step S3 to determine whether all the data have been written to the ROM region or not. If the writing of all the data is not completed, the operation flow returns to Step S2 to perform the writing of data to the ROM region. When the writing of all the data is completed, the operation flow proceeds to Step S4 where the write-to-ROM disabling flag is set to 1 and the operation is completed.

On the other hand, if it is determined in Step S1 that the write-to-ROM disabling flag is 1, the operation flow proceeds to Step S5 to caution about that the writing to the ROM region is disabled. Then the operation flow comes to an end.

In the aforementioned image forming apparatus, the suitability of each of the imaging cartridges 10A to 10D mounted in the apparatus body 1 is determined as follows. The CPU reads out the cartridge identification information, such as the toner color information, written to the ROM region 322 by way of the program installed in the program region 321. The CPU communicates with the main CPU 3 disposed in the apparatus body 1 via the signal lines 5A to 5C. The CPU compares the retrieved cartridge identification information with the data stored in the main memory 4 so as to determine on the suitability of each of the imaging cartridges 10A to 10D.

If each of the imaging cartridges 10A to 10D mounted in the apparatus body 1 is suitable, the imaging cartridge is allowed to perform image formation. If any of the imaging cartridges 10A to 10D is determined to be unsuitable, the CPU cautions about the unsuitable imaging cartridge and inhibits the image formation by the unsuitable one of the imaging cartridges 10A to 10D.

In the process cartridge for use in image forming apparatus and the image forming apparatus according to the invention, the control program for writing data to the read-only region is installed in the arbitrarily rewritable region of the non-volatile memory disposed on the chip. Therefore, the cartridge identification information, such as the toner color information, used for determining on the suitability of the cartridge may be written to the read-only region based on the control program installed in the read-only region.

After the cartridge identification information is written to the read-only region, the use of the control program installed in the arbitrarily rewritable region is limited. Further, if this control program is deleted or overwritten with other data, the cartridge identification information written to the read-only region cannot be overwritten.

As a result, a proper image formation may be carried out stably in the image forming apparatus having the aforementioned process cartridge for image forming apparatus mounted in the apparatus body thereof, because the non-volatile memory of the chip disposed in the process cartridge for image forming apparatus is adapted to prevent the cartridge identification information written to the read-only region thereof from being mistakenly rewritten.

Although the present invention has been fully described by way of examples, it is to be noted that various changes and modifications will be apparent to those skilled in the art.

Therefore, unless otherwise such changes and modifications depart from the scope of the present invention, they should be construed as being included therein.

The invention claimed is:

1. A process cartridge for an image forming apparatus, the process cartridge comprising a chip including a rewritable non-volatile memory, wherein the non-volatile memory at least includes a read-only region and an arbitrarily rewritable region, wherein the chip is encoded in the arbitrarily rewritable region with a control program for writing data to the read-only region; and the process cartridge further comprises a CPU for rendering the control program inoperative after the completion of the writing of data to the read-only region.

2. A process cartridge for use in image forming apparatus according to claim 1, wherein the CPU is programmed to delete the control program installed in the arbitrarily rewritable region after the completion of the writing of data to the read-only region.

3. A process cartridge for use in image forming apparatus according to claim 1, wherein the CPU is programmed to overwrite the control program installed in the arbitrarily rewritable region with other data after the completion of the writing of data to the read-only region.

4. A process cartridge for use in image forming apparatus according to claim 1, wherein the rewritable non-volatile memory is a flash memory.

5. A process cartridge for use in image forming apparatus according to claim 1, wherein the CPU writes data to the read-only region based on the control program installed in the arbitrarily rewritable region.

6. A process cartridge for use in image forming apparatus according to claim 5, wherein the CPU is disposed on the same chip that includes the rewritable non-volatile memory.

7. A process cartridge for use in image forming apparatus according to claim 1, wherein the arbitrarily rewritable region is divided into plural sub-regions and the control program is installed in one of the sub-regions.

8. A process cartridge for use in image forming apparatus according to claim 1, wherein the data written to the read-only region is cartridge identification information used for determining on the suitability of the cartridge.

9. An image forming apparatus comprising the process cartridge for use in image forming apparatus according to claim 1 mounted in an apparatus body thereof.

10. An image forming apparatus according to claim 9, wherein the CPU is programmed to delete the control program installed in the arbitrarily rewritable region of the process cartridge for use in image forming apparatus after the completion of the writing of data to the read-only region.

11. An image forming apparatus according to claim 9, wherein the CPU is programmed to overwrite the control program installed in the arbitrarily rewritable region of the process cartridge for use in image forming apparatus with other data after the completion of the writing of data to the read-only region.

12. An image forming apparatus according to claim 9, wherein the rewritable non-volatile memory of the process cartridge for use in image forming apparatus is a flash memory.

13. An image forming apparatus according to claim 9, wherein the CPU writes data to the read-only region based on the control program installed in the arbitrarily rewritable region.

14. An image forming apparatus according to claim 13, wherein the CPU is disposed on the same chip that includes the rewritable non-volatile memory.

15. An image forming apparatus according to claim 9, wherein the arbitrarily rewritable region of the process cartridge for use in image forming apparatus is divided into plural sub-regions and the control program is installed in one of the sub-regions.

16. An image forming apparatus according to claim 9, wherein the data written to the read-only region of the process cartridge for use in image forming apparatus is cartridge identification information used for determining on the suitability of the cartridge.

17. An image forming apparatus according to claim 9, wherein a plural number of the process cartridges for use in image forming apparatus are mounted in the apparatus body.

18. An image forming apparatus according to claim 9, wherein a main CPU disposed in the apparatus body is connected with the chip disposed in the process cartridge for use in image forming apparatus in a manner to communicate with each other.

* * * * *